US007462045B1

(12) United States Patent
Lee

(10) Patent No.: US 7,462,045 B1
(45) Date of Patent: Dec. 9, 2008

(54) CONNECTOR LOCK FOR COMPUTER INTERFACE PORTS

(75) Inventor: Miko Lee, Hsinchuang (TW)

(73) Assignee: ABA UFO International Corp., Taipei Hsien (TW)

( * ) Notice: Subject to any disclaimer, the term of this patent is extended or adjusted under 35 U.S.C. 154(b) by 0 days.

(21) Appl. No.: 11/899,711

(22) Filed: Sep. 7, 2007

(51) Int. Cl.
*H01R 13/44* (2006.01)

(52) U.S. Cl. ..... 439/133; 439/304

(58) Field of Classification Search ..... 439/133, 439/134, 149, 304
See application file for complete search history.

(56) References Cited

U.S. PATENT DOCUMENTS 5,055,057 A * 10/1991 Boyer ..... 439/134
5,964,598 A * 10/1999 Gonzales ..... 439/133
6,508,654 B1 * 1/2003 Tatz ..... 439/134
7,128,586 B2 * 10/2006 Kung ..... 439/133

* cited by examiner

*Primary Examiner*—Hien Vu
(74) *Attorney, Agent, or Firm*—William E. Pelton, Esq.; Cooper & Dunham LLP

(57) ABSTRACT

A connector lock for a computer interface port has a block and a key. The block corresponds to and is mounted removably in the computer interface port to prevent any peripheral device from being inserted into or making an electrical connection with the computer interface port and has two sides, two retaining members and a channel. The retaining members protrude respectively outward from the sides of the block and are resilient. The key is inserted in the channel and turned to remove the block from the computer interface port. When the block is plugged into the computer interface port, the retaining members press tightly against inner sidewalls of the computer interface port. Only the correct key can easily remove the block from the computer interface port so the connector lock prevents malicious or accidental information exchange between a computer and periphery using the computer interface port.

8 Claims, 5 Drawing Sheets

CONNECTOR LOCK FOR COMPUTER INTERFACE PORTS

BACKGROUND OF THE INVENTION

1. Field of the Invention

The present invention relates to a connector lock, and more particularly to a connector lock for a computer interface port.

2. Description of Related Art

Portable storage mediums are widely used today, and comprise peripheries designed for storage such as portable flash memory devices, portable hard drives and the like and peripheries having storage features added to their function such as MP3 players, mobile phones, personal digital assistants and the like. Computers have interface ports for connecting the peripheries. The interface ports may be universal serial bus (USB), USB 2, Firewire or the like.

However, information exchange between a computer having interface ports is easy since anyone with access to the computer can plug a portable storage medium into the computer interface port and download information from the computer to the portable storage medium or use the portable storage medium to upload information to the computer. The downloaded information may comprise personal or confidential files, documents, pictures or the like. Uploaded information may comprise malware such as Spyware, viruses, worms, Trojan horses or the like. Therefore, a means to prevent malicious or accidental information exchange using an interface port is required to protect computers and information stored therein, especially for public use computers such as in libraries, schools, internet cafés or the like, as well as home and business' computers.

This may currently be achieved using some software, however software cannot prevent a user from inserting their periphery and once electrical connection has been made between periphery and computer, there is a risk of data transmission and exchange.

To overcome this problem, the present invention provides a connector lock for a computer interface port to mitigate or obviate the aforementioned problems.

SUMMARY OF THE INVENTION

The main objective of the invention is to provide a connector lock to prevent malicious or accidental exchange of information between a computer and a periphery through a computer interface port.

The connector lock in accordance with the present invention comprises a block and a key. The block corresponds to and is mounted removably in the computer interface port to prevent any peripheral device from being inserted into or making electrical contact with the computer interface port and has two sides, two retaining members and a channel. The retaining members protrude respectively outward from the sides of the block and are resilient. The key is inserted in the channel and turned to remove the block from the computer interface port. When the block is plugged into the computer interface port, the retaining members press tightly against inner sidewalls of the computer interface port. Only the correct key can easily remove the block from the computer interface port so the connector lock prevents malicious or accidental information exchange between a computer and periphery using the computer interface port.

Other objectives, advantages and novel features of the invention will become more apparent from the following detailed description when taken in conjunction with the accompanying drawings.

DETAILED DESCRIPTION OF PREFERRED EMBODIMENT

Figure 1:
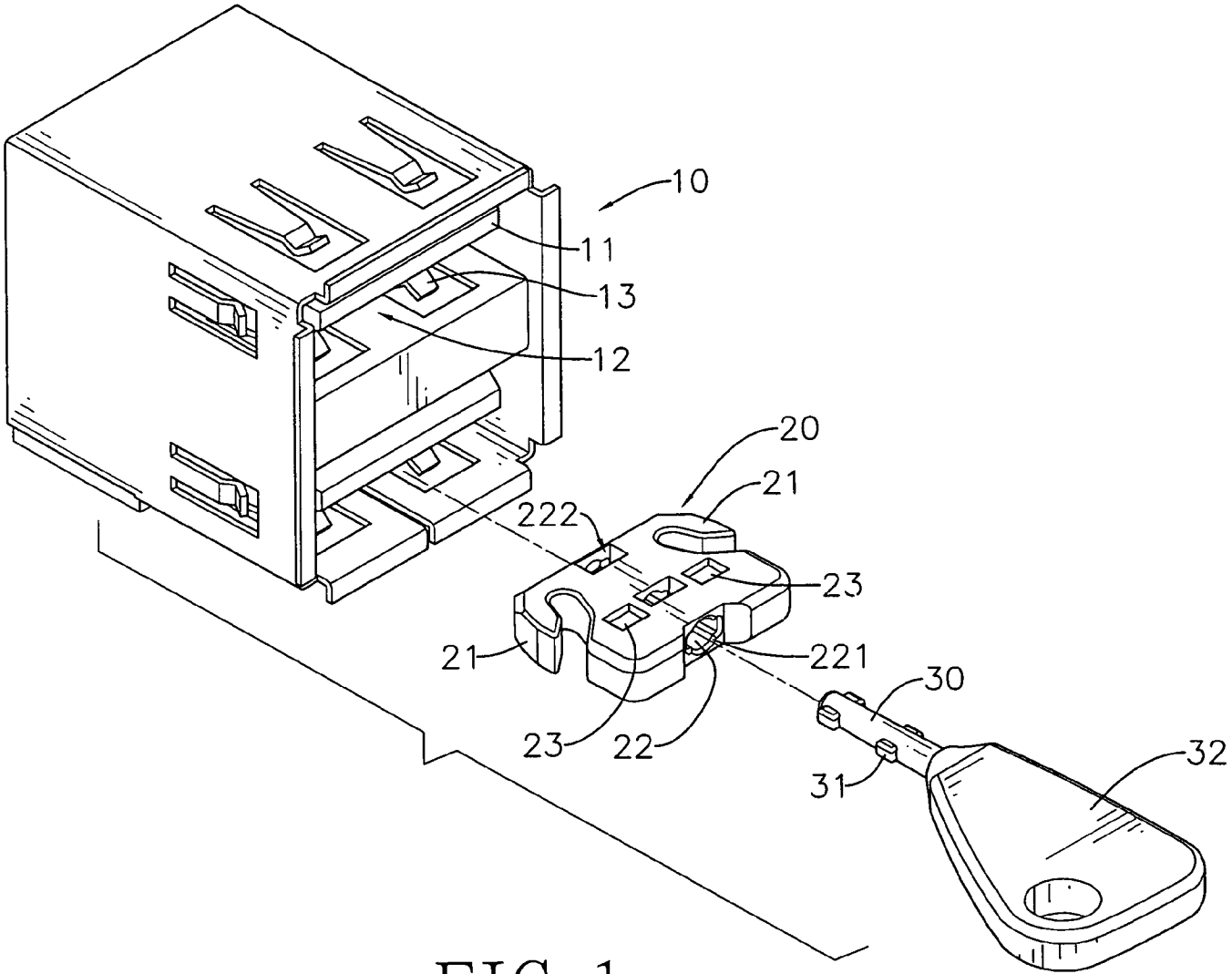
FIG. 1 is a perspective view of a connector lock in accordance with the present invention and a Universal Serial Bus (USB) interface port.

With reference to FIG. 1, a connector lock in accordance with the present invention is used to prevent information exchange using a computer interface port. The computer interface port comprises a socket and may be a universal serial bus (USB), USB2, micro-USB, Firewire or the like.

The socket has two sidewalls and a slot formed in the socket.

The USB interface port further comprises two USB sockets (10), and each USB socket (10) further has a lower inner surface, a tongue (11), a USB slot (12) and multiple positioning members (13). The tongue (11) is mounted in the socket (10). The USB slot (12) is formed between the lower inner surface of the socket (10) and the tongue (11). The positioning members (13) are mounted on the lower inner face of the socket (10).

The connector lock comprises a block (20) and a key (30).

Figure 2:
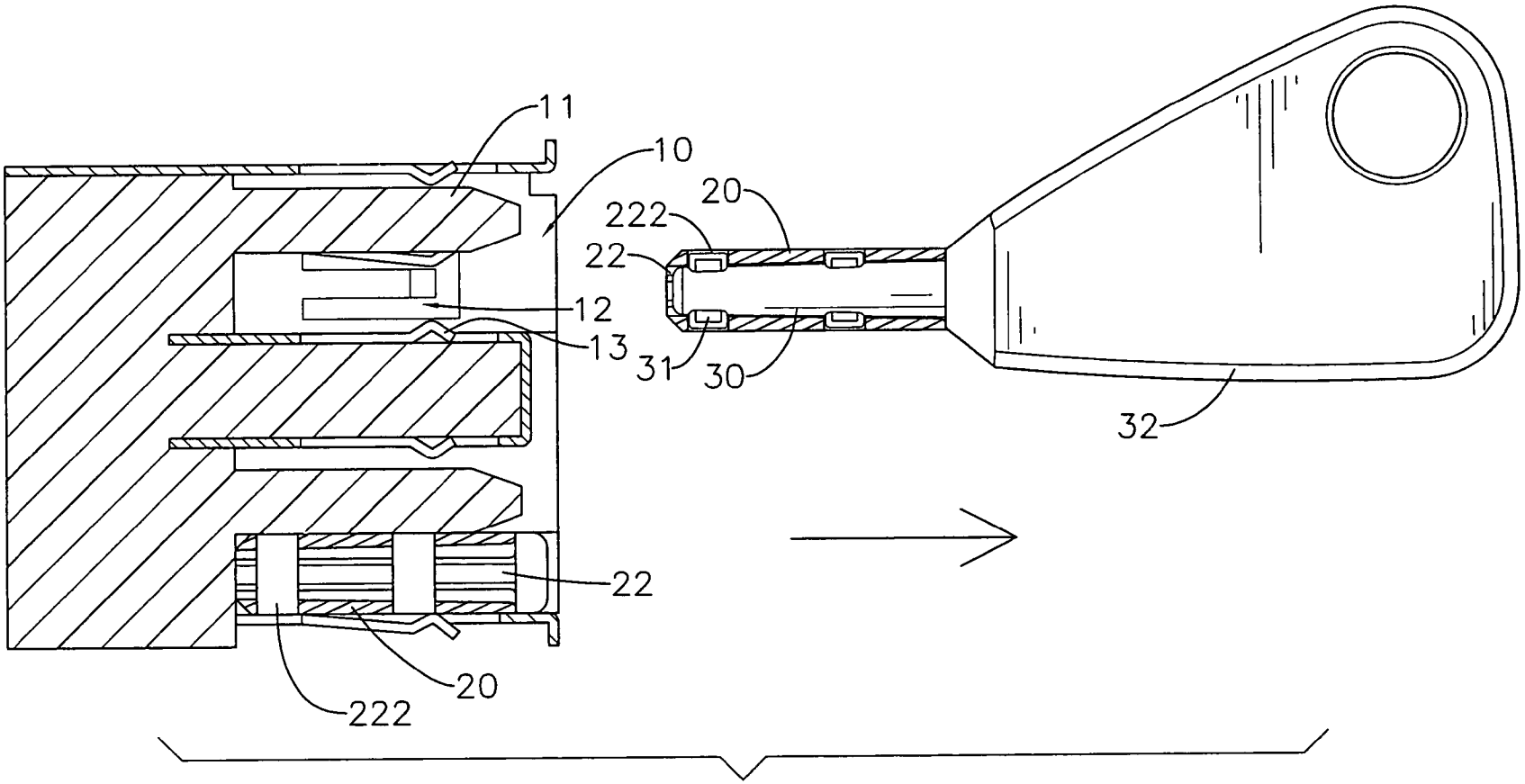
FIG. 2 is a side view in partial section of the connector lock and the USB interface port in FIG. 1, showing that a key inserted in a channel of a block.
Figure 3:
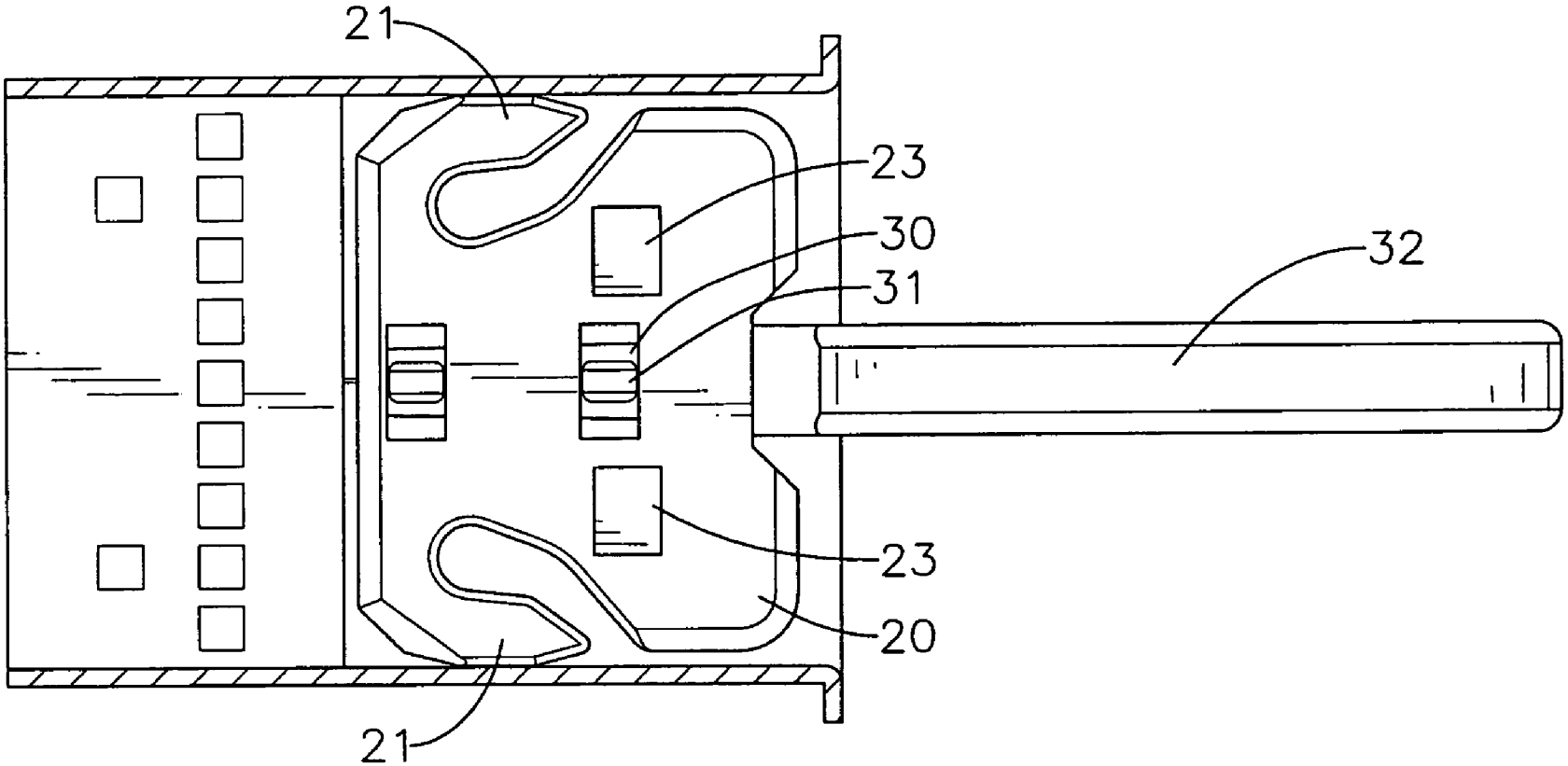
FIG. 3 is a top view in partial section of the connector lock and the USB interface port in FIG. 1, showing that the connector lock is plugged in the USB interface port.
Figure 4:
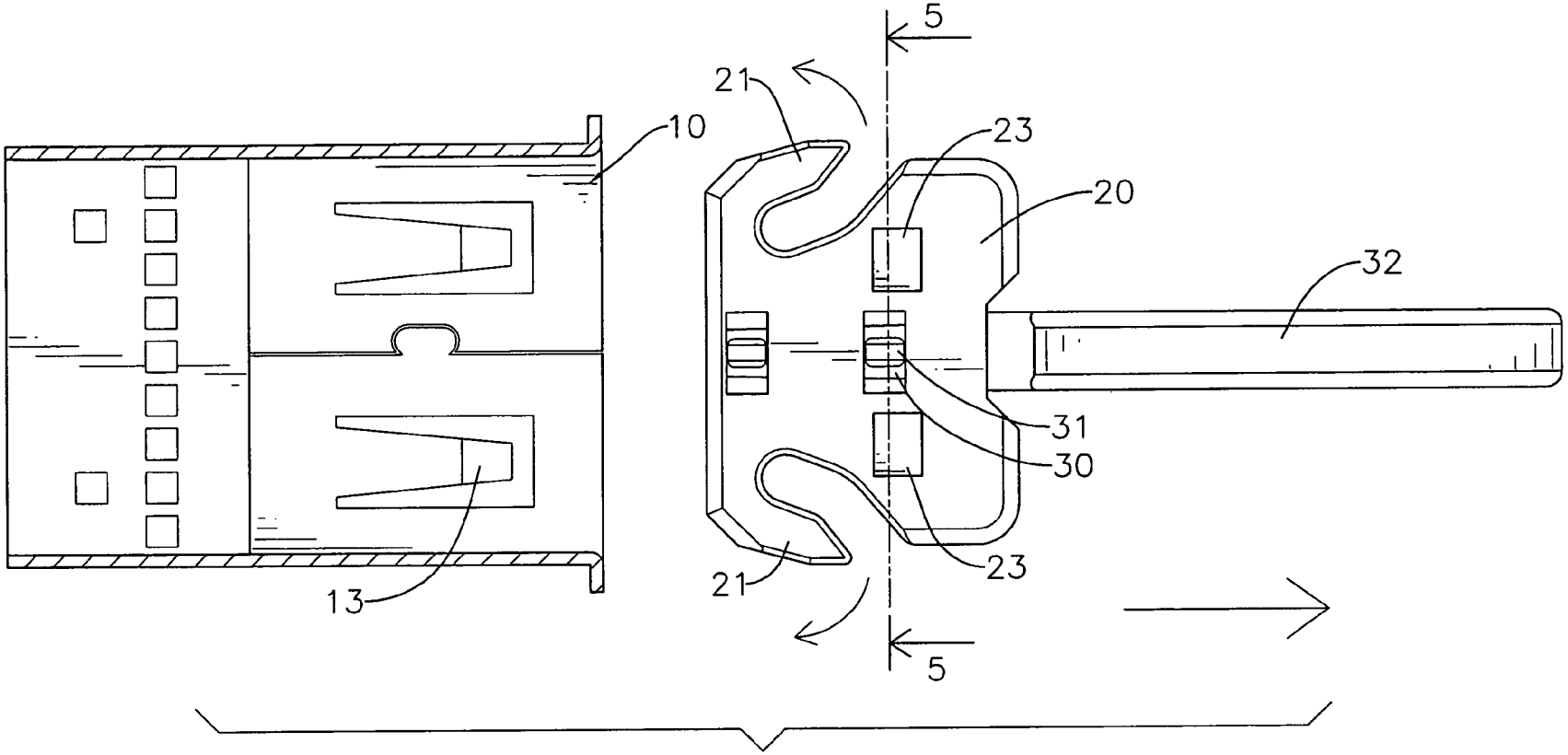
FIG. 4 is a top view in partial section of the connector lock is removed from the USB interface port in FIG. 3.

The block (20) corresponds to and is mounted removably in the slot (12) to prevent any peripheral device from plugging into the slot (12). With further reference to FIGS. 2 to 4, the block (20) has a front, a rear, a top, a bottom, two sides, two retaining members (21), an opening (221), a channel (22), multiple keyholes (222) and multiple optional recesses (23).

The rear of the block (20) communicates with the slot (12) of the interface port.

The retaining members (21) are formed on and extend respectively outward from the sides of the block (20), are resilient, may be adjacent to the front of the block (20), extend toward the rear of the block (20) and each has an outer edge. The outer edges of the retaining members (21) are separated by a distance greater than a distance between the inner sidewalls of the socket (10). Therefore, when the block (20) is plugged into the slot (12), the retaining members (21) will press tightly against the inner sidewalls of the socket (10) and the block (20) is mounted tightly in the slot (12) and is difficult to remove from the slot (12) to prevent information exchange through the interface port.

The opening (221) is formed on the rear of the block (20).

The channel (22) is formed in the block (20) and communicates with the opening (221).

The keyholes (222) are formed in the block (20) and communicate with the channel (22), and at least one keyhole (222) may be formed through the top of the block (20) and at least one keyhole (222) may be formed through the bottom of the block (20).

Figure 5:
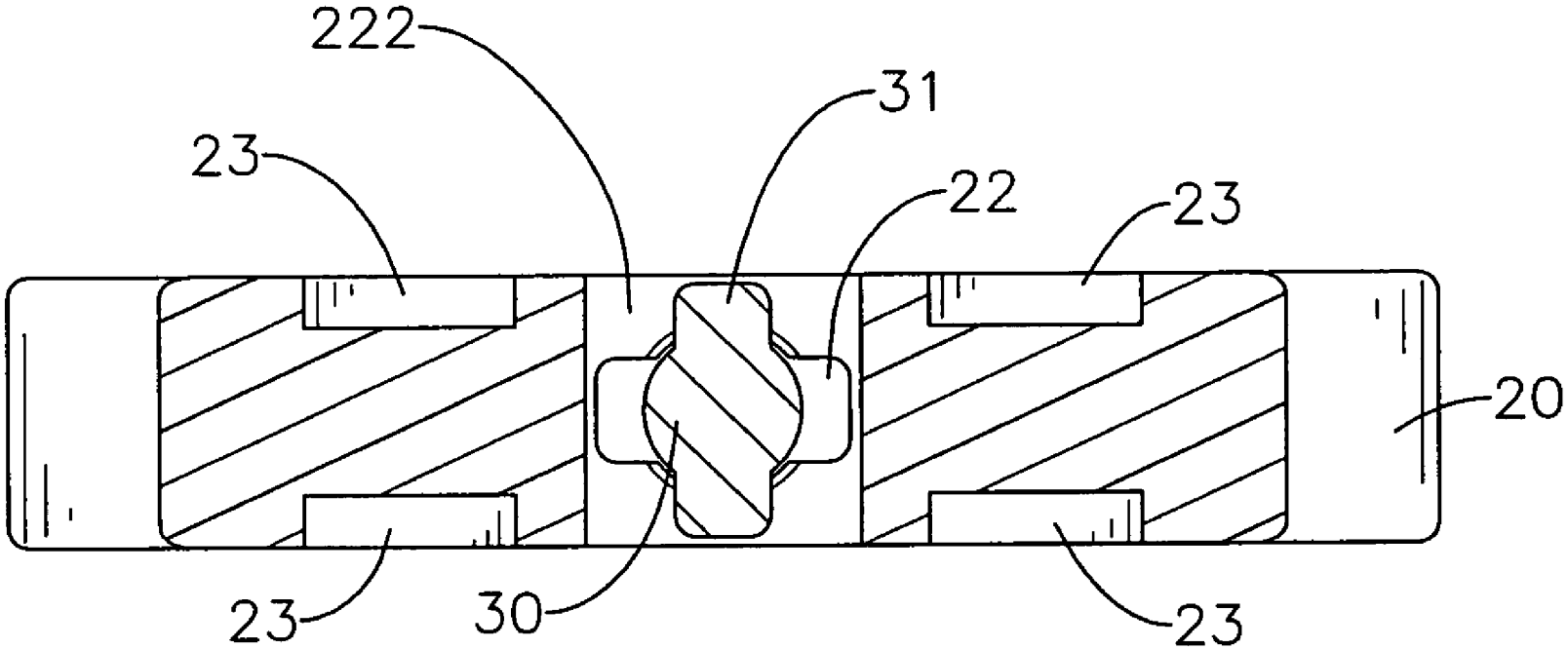
FIG. 5 is a front view in partial section, along line 5-5, of the connector lock in FIG. 4.

With further reference to FIG. 5, the recesses (23) are formed in the top and the bottom of the block (20) to removably engage the positioning members (13) in the USB socket (10).

The key (30) is removably mounted rotatably in the channel (21) through the opening (221) for engaging and removing the block (20) from the slot (12) and has a shaft and an optional handle (32).

The shaft has a proximal end, a distal end and multiple teeth (31).

The distal end of the shaft corresponds to and is inserted into the channel (21).

The teeth (31) are formed on the shaft (30) and correspond respectively to the keyholes (222) of the block (20). Accordingly, the teeth (31) engage the corresponding keyholes (222) when the key (30) is inserted into the channel (22) and then turned. Furthermore, different numbers or locations of the teeth (31) and keyholes (222) result in different type of keys (30) that correspond to different blocks (20). Only the key (30) having teeth (31) corresponding to the keyholes (222) in the corresponding block (20) can remove the block (20) plugged in the slot (12).

The handle (32) is formed on the proximal end of the key (30) and protrudes out of the block (20) when the key (30) is inserted in the channel (21) to allow a user to hold the key (30), turn the key (30) to engage the teeth (31) with the keyholes (222) and pull the block (20) out from the channel (22).

The block (20) of the connector lock easily blocks and prevents insertion of or electrical contact to a periphery, thereby preventing any computer interface port, including, but not limited to USB interface ports from being used, but is easily unlocked and removed with a proper key (30). When the block (20) is plugged into the computer interface port, the block (20) cannot be easily removed from the computer interface port because the block (20) corresponds to and is mounted tightly in the computer interface port. Therefore, the connector lock prevents malicious and accidental exchange of information between a computer and a periphery using the interface port.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A connector lock for a computer interface port comprising:

a block having a front;

a rear;

a top;

a bottom;

two sides;

two retaining members being formed on and extending respectively outward from the sides of the block and being resilient, and each retaining member having an outer edge being separated from each other;

an opening being formed on the rear of the block;

a channel being formed in the block and communicating with the opening; and multiple keyholes being formed in the block and communicating with the channel; and a key being removably mounted rotatably in the channel through the opening and having a shaft having a distal end corresponding to and being inserted into the channel; and a proximal end; and multiple teeth being formed on the shaft and corresponding respectively to the keyholes of the block to engage the corresponding keyholes when the key is inserted into the channel and turned.

2. The connector lock as claimed in claim 1, wherein the retaining members are adjacent to the front of the block and extend toward the rear of the block.

3. The connector lock as claimed in claim 1, wherein at least one of the keyhole is formed through the top of the block and at least one keyhole is formed through the bottom of the block.

4. The connector lock as claimed in claim 1, wherein the block further has multiple recesses formed in the top and the bottom of the block.

5. The connector lock as claimed in claim 1, wherein the key further has a handle formed on the proximal end of the key and protrudes out of the block when the key is inserted in the channel.

6. The connector lock as claimed in claim 2, wherein at least one of the keyhole is formed through the top of the block and at least one keyhole is formed through the bottom of the block.

7. The connector lock as claimed in claim 2, wherein the block further has multiple recesses formed in the top and the bottom of the block.

8. The connector lock as claimed in claim 2, wherein the key further has a handle formed on the proximal end of the key and protrudes out of the block when the key is inserted in the channel.

* * * * *